US011255626B2

(12) United States Patent
Gray

(10) Patent No.: US 11,255,626 B2
(45) Date of Patent: Feb. 22, 2022

(54) DISK LAUNCHER SYSTEM

(71) Applicant: David L. Gray, Midland, TX (US)

(72) Inventor: David L. Gray, Midland, TX (US)

( * ) Notice: Subject to any disclaimer, the term of this patent is extended or adjusted under 35 U.S.C. 154(b) by 0 days.

(21) Appl. No.: 17/113,205

(22) Filed: Dec. 7, 2020

(65) Prior Publication Data

US 2021/0172697 A1 Jun. 10, 2021

Related U.S. Application Data

(60) Provisional application No. 62/943,808, filed on Dec. 5, 2019.

(51) Int. Cl.

| | |
|---|---|
| ***F41B 3/02*** | (2006.01) |
| ***A63H 33/18*** | (2006.01) |
| ***F41B 7/08*** | (2006.01) |

(52) U.S. Cl.

CPC ..... *F41B 3/02* (2013.01); *A63H 33/18* (2013.01); *F41B 7/08* (2013.01)

(58) Field of Classification Search

CPC ..... F41B 3/00; F41B 3/02; F41B 7/00; F41B 7/08

See application file for complete search history.

(56) References Cited

U.S. PATENT DOCUMENTS

| | | | | | |
|---|---|---|---|---|---|
| 1,024,374 | A * | 4/1912 | Stambaugh | F41B 3/005 | 124/21 |
| 1,261,992 | A * | 4/1918 | Algie | F41B 3/005 | 124/21 |
| 2,056,446 | A | 10/1936 | Dodge, Jr. | | |
| 2,408,984 | A * | 10/1946 | Lawson, Sr. | F41B 3/005 | 124/17 |
| 3,905,350 | A * | 9/1975 | Becker | A63H 27/14 | 124/17 |
| 4,016,854 | A * | 4/1977 | Lehman | F41B 7/08 | 124/27 |
| 4,059,089 | A * | 11/1977 | Lehman | A63H 27/14 | 124/27 |
| 8,967,130 | B2 * | 3/2015 | Victor | F41B 3/03 | 124/36 |

* cited by examiner

*Primary Examiner* — John A Ricci
(74) *Attorney, Agent, or Firm* — Neustel Law Offices

(57) ABSTRACT

A disk launcher system for effectively launching a disk. The disk launcher system generally includes a platform having an upper surface, a biasing member attached to the platform adapted to apply a biasing force to a disk positioned on the platform to launch the disk from the platform, a catch member movably positioned with respect to the platform adapted to selectively engage the disk, and a timing post extending upwardly from the upper surface of the platform that forces the disk to move to a side of the timing post after being released by the catch member resulting in rotation of the disk. A trigger may be connected to the catch member to allow for selective movement of the catch member by a user. A cover may also selectively cover a portion of the platform to help protect the user and guide the disk.

20 Claims, 10 Drawing Sheets

DISK LAUNCHER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a disk launcher system for launching disks.

Related Art

Any discussion of the related art throughout the specification should in no way be considered as an admission that such related art is widely known or forms part of common general knowledge in the field.

Slingshots have been around for years. A typical slingshot has a Y-shape with an elastic band attached between the upper two posts. The user positions a projectile upon a central portion of the elastic band then pulls back on the elastic band and then releases the elastic band to launch the projectile forwardly. While slingshots are suitable for launching round shaped projectiles (e.g. rocks), they are not as suitable for launching a disk because there is no way to keep the disk aligned along a plane and for other reasons.

SUMMARY

An example embodiment is directed to a disk launcher system. An example embodiment of disk launcher system generally includes a platform having an upper surface, a biasing member attached to the platform adapted to apply a biasing force to a disk positioned on the platform to launch the disk from the platform, a catch member movably positioned with respect to the platform adapted to selectively engage the disk, and a timing post extending upwardly from the upper surface of the platform that forces the disk to move to a side of the timing post after being released by the catch member resulting in rotation of the disk. A trigger may be connected to the catch member to allow for selective movement of the catch member by a user. A cover may also selectively cover a portion of the platform to help protect the user and guide the disk.

There has thus been outlined, rather broadly, some of the embodiments of the disk launcher system in order that the detailed description thereof may be better understood, and in order that the present contribution to the art may be better appreciated. There are additional embodiments of the disk launcher system that will be described hereinafter and that will form the subject matter of the claims appended hereto. In this respect, before explaining at least one embodiment of the disk launcher system in detail, it is to be understood that the disk launcher system is not limited in its application to the details of construction or to the arrangements of the components set forth in the following description or illustrated in the drawings. The disk launcher system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
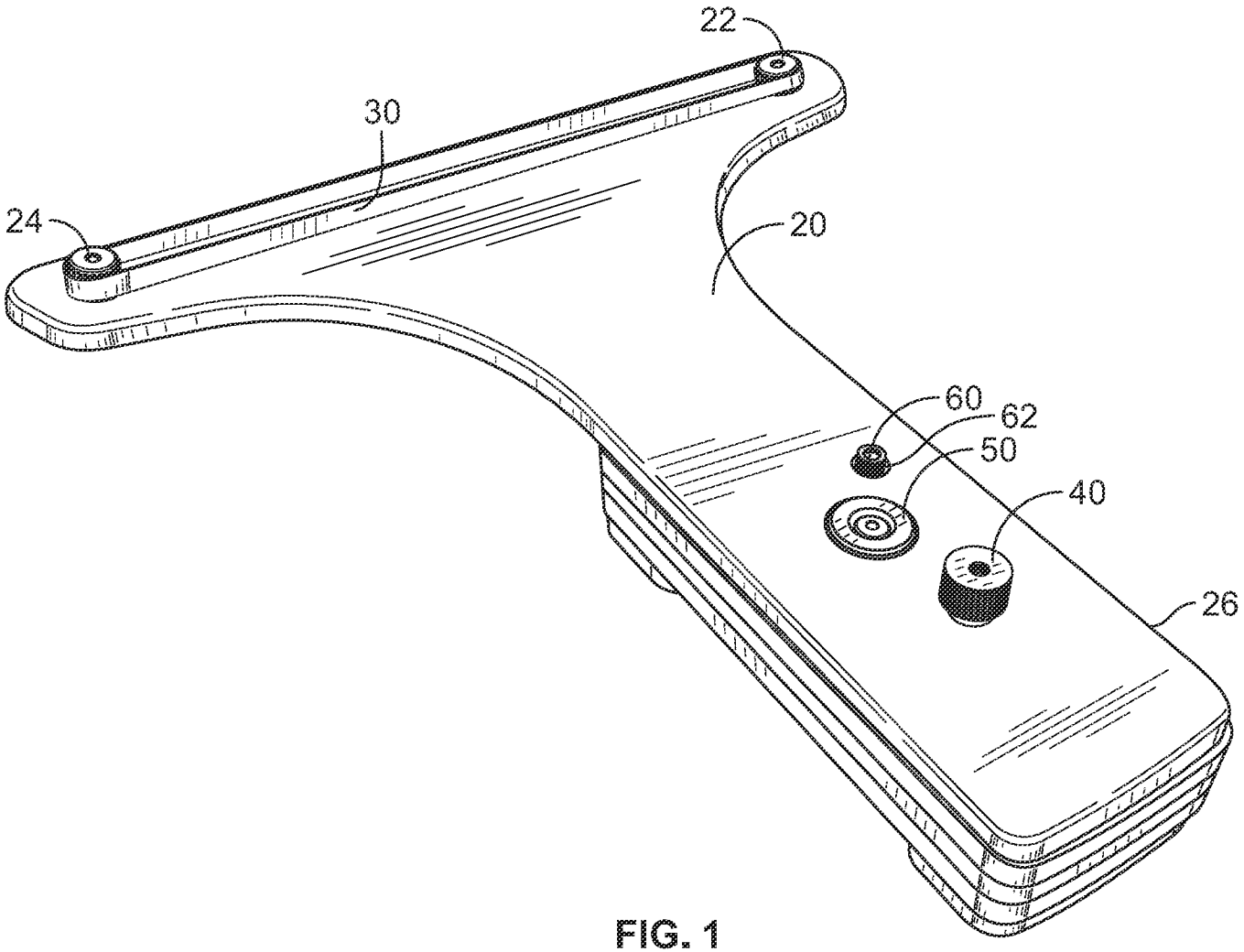
FIG. 1 is a perspective view of a disk launcher system with the trigger system in the intermediate release position in accordance with an example embodiment.

An example embodiment of the disk launcher system generally comprises a platform 20 having an upper surface, a biasing member 30 attached to the platform 20 adapted to apply a biasing force to a disk 10 positioned on the platform 20 to launch the disk 10 from the platform 20, a catch member 50 movably positioned with respect to the platform 20 adapted to selectively engage the disks 10, and a timing post 60 extending upwardly from the upper surface of the platform 20 that forces the disk 10 to move to a side of the timing post 60 after being released by the catch member 50 resulting in rotation of the disk 10. A trigger may be connected to the catch member 50 to allow for selective movement of the catch member 50 by a user. A cover 70 may also selectively cover 70 a portion of the platform 20 to help protect the user and guide the disk 10.

B. Platform

FIGS. 1 through 5B, 7, 10 through 14 illustrate examples of a suitable platform 20 having an upper surface, a first end and a second end opposite of the first end. The upper surface of the platform 20 is planar to assist in guiding the disk 10 during the launching of the disk 10 to maintain a constant plane of movement for the disk 10. The platform 20 is comprised of a rigid structure and may be comprised of various materials such as plastic, metal, wood, composite materials and the like.

FIGS. 1, 2A, 3A, 5A, 5B, 7, 10, 11, 12 and 14 illustrate one embodiment of the platform 20 having a T-shape forming a handle 26 near the first end of the platform 20. However, various other shapes may be used for the platform 20 without using the functionality thereof.

C. Posts

As shown in FIGS. 1, 2A, 3A, 5A and 5B, one or more posts 22, 24 may be attached to and extend upwardly from the platform 20 near the second end of the platform 20. In an example embodiment, a first post 22 is near a first side of the platform 20 and a second post 24 is near a second side of the platform 20 opposite of the first post 22. The biasing member 30 (e.g. elastic member, bow) is attached to one or more of the posts 22, 24 to provide a biasing force that draws the disk 10 from near the first end of the platform 20 towards the second end of the platform 20.

If the biasing member 30 is an elastic member (e.g. rubber band), a first post 22 and a second post 24 may be used with the elastic member connected between the first post 22 and the second post 24 as shown in FIG. 1 of the drawings. If the biasing member 30 is comprised of a bow, only one post may be needed to support the bow and with the draw string attached to the bow to engage the disk 10 and draw the disk 10 forwardly similar to a crossbow.

D. Biasing Members

The biasing member 30 may be attached to the one or more posts 22, 24 extending upwardly from the platform 20 or the biasing member 30 may be directly connected to the platform 20 near the second end of the platform 20. The biasing member 30 is adapted to apply a biasing force to a disk 10 positioned on the platform 20 to launch the disk 10 in a direction extending from the first end towards the second end of the platform 20. The biasing member 30 is adapted to apply the biasing force along a substantial length of the upper surface of the platform 20 to accelerate the disk 10 to a launch speed sufficient to propel the disk 10 a significant distance in a horizontal manner.

In one example embodiment, the biasing member 30 is comprised of one or more elastic bands (e.g. one or more rubber bands) attached to the first post 22 and the second post 24 as shown in FIGS. 1, 2A, 3A, 5A and 5B of the drawings. The elastic bands may have their distal ends attached to the first post 22 and the second post 24 respectively or the elastic bands may be looped about the first post 22 and the second post 24 (see FIGS. 1, 2A, 3A, 5A and 5B).

In another example embodiment, the biasing member 30 may be comprised of a bow and a draw string similar to a conventional crossbow structure. The bow may be directly attached to the platform 20 or attached to one or more posts 22, 24.

Other types of biasing members 30 and biasing devices may be used to propel the disk 10 forwardly on the platform 20. For example, while tension related biasing devices (e.g. elastic bands, bow and draw string) have been discussed, other types of biasing devices may be used such as gas powered, motorized and the like may be used to apply a biasing force to the disk 10 using a connector such as, but not limited to, a string.

E. Catch Member

Figure 2A:
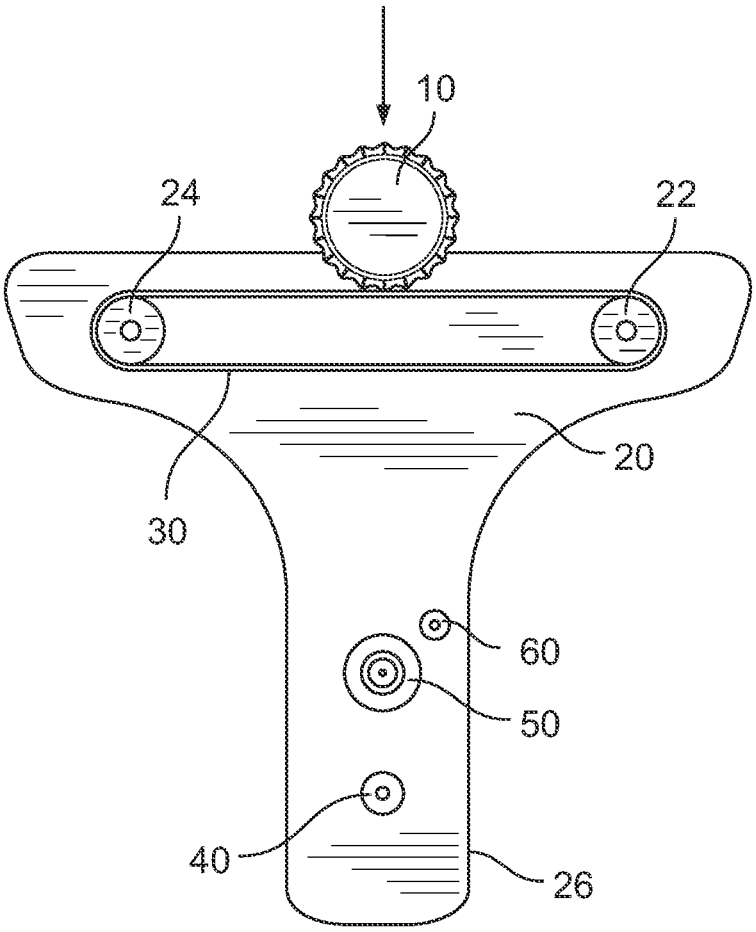
FIG. 2A is a top view of the disk launcher system in accordance with an example embodiment.
Figure 2B:
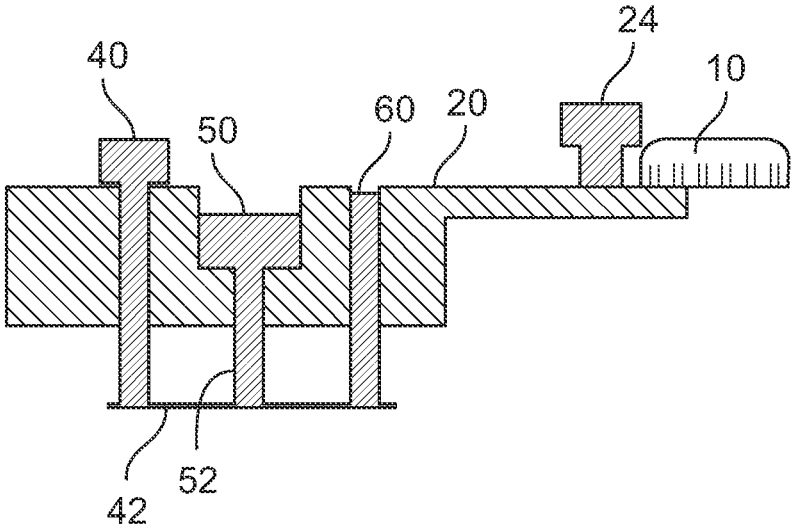
FIG. 2B is a side cutaway view of the disk launcher system illustrated in FIG. 2A showing the trigger assembly in a lowered position for allowing loading of the system with a disk.
Figure 3A:
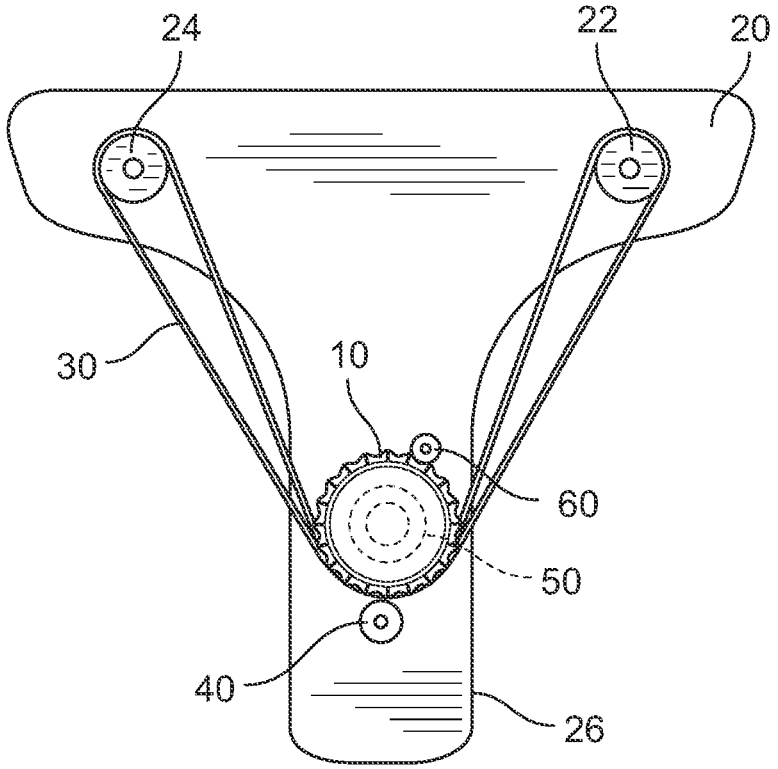
FIG. 3A is a top view of the disk launcher system with a disk positioned in a launch position wherein the disk is prevented from being released in accordance with an example embodiment.
Figure 3B:
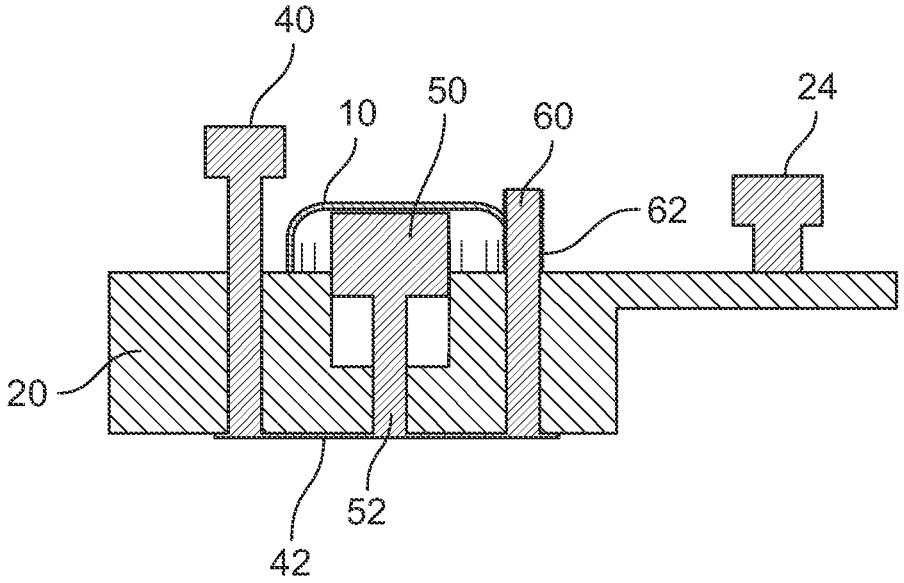
FIG. 3B is a side cutaway view of the disk launcher system illustrated in FIG. 3A showing the trigger assembly in a raised position preventing the release of the disk in accordance with an example embodiment.
Figure 4:
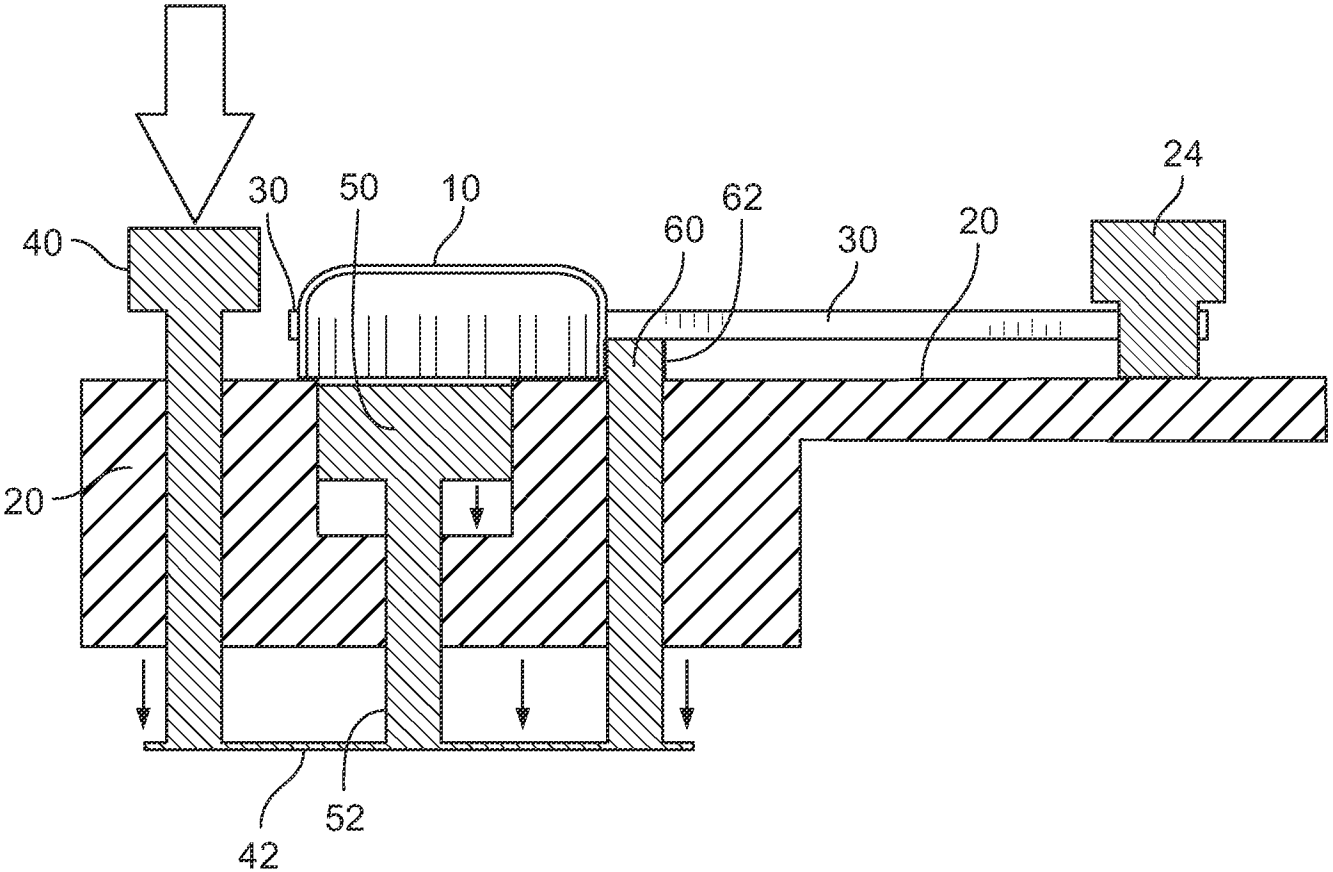
FIG. 4 is a side cutaway view of the disk launcher system showing the trigger assembly in an intermediate position allowing for the release of the disk in accordance with an example embodiment.

The catch member 50 is movably positioned with respect to the platform 20 as illustrated in FIGS. 2B, 3B and 4 of the drawings. The catch member 50 is adapted to move to a first position to retain the disk 10 in a cocked position (FIG. 3B) and a second position to release the disk 10 from the cocked position (FIGS. 2B and 4).

The catch member 50 moves within a corresponding opening within the platform 20 as shown in FIGS. 1 through 4 of the drawings. When the catch member 50 is moved to the first position to retain the disk 10 in the cocked position, the catch member 50 extends above the upper surface of the platform 20 to engage the disk 10 (e.g. the interior portion of the disk 10 as shown in FIG. 3B) to prevent movement of the disk 10 when the biasing member 30 is attached to the disk 10. When the catch member 50 is moved to the release position, the catch member 50 is positioned below the upper surface of the platform 20 (FIGS. 2B and 4) thereby allowing the disk 10 to move forwardly unobstructed by the catch member 50.

Figure 5B:
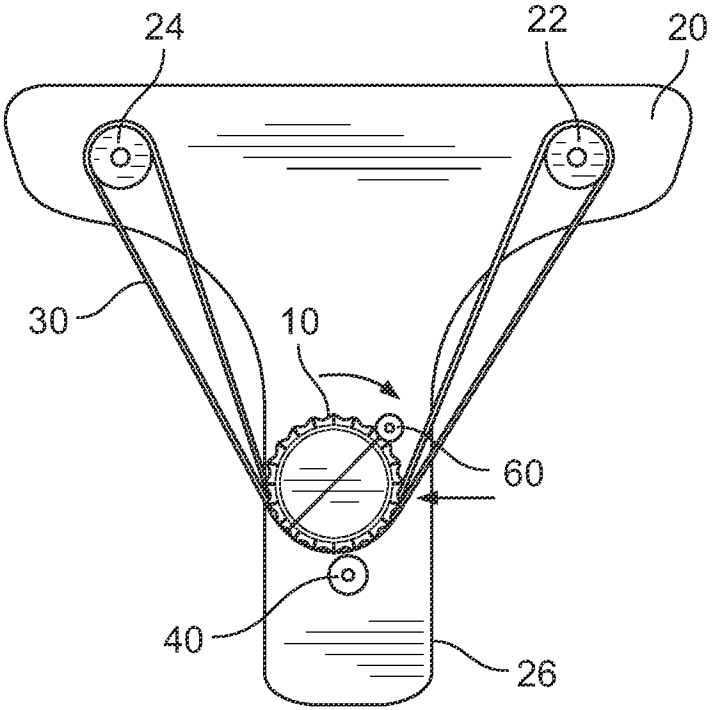
FIG. 5B is a top view of the disk launcher system with the trigger assembly in the intermediate position allowing for the release of the disk in accordance with an example embodiment.
Figure 5A:
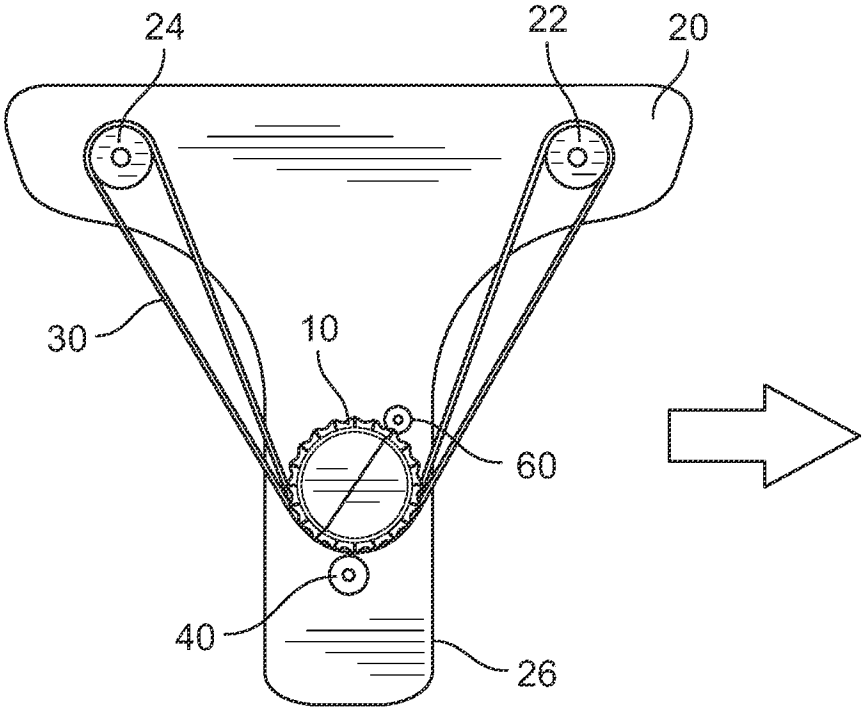
FIG. 5A is a top view of the disk launcher system with the trigger assembly in the raised position retaining the disk in the cocked position in accordance with an example embodiment.

The catch member 50 may be comprised of a magnet attached to a support post 52 as shown in FIGS. 2B, 3B and 4 of the drawings. The magnet has a strong magnetic field that engages the disk 10 (when made of a metal material such as a bottle cap) drawing the disk 10 downwardly against the platform 20 to selectively retain the disk 10 in the cocked position as shown in FIGS. 3A and 5A of the drawings. The magnet also pulls upwardly on the catch member 50 towards the disk 10 member thereby preventing the catch member 50 from accidentally being released until intentionally pushed downwardly by the user.

When the catch member 50 extends upwardly above the upper surface of the platform 20, the catch member 50 engages the interior portion of the disk 10 to prevent forward movement of the disk 10 by the biasing member 30. The pressure of the biasing member 30 on the disk 10 causes the catch member 50 to engage the sidewall of the opening it movably extends within.

When the catch member 50 is lowered below the upper surface of the platform 20, the disk 10 is thereby released allowing the disk 10 to move forwardly by the biasing member 30 as shown in FIG. 4 of the drawings for example. The catch member 50 may be manually manipulated by a user (e.g. directly with their fingers, indirectly using a trigger mechanism) or remotely controlled by the user via an electrical actuator.

F. Timing Post

Figure 14:
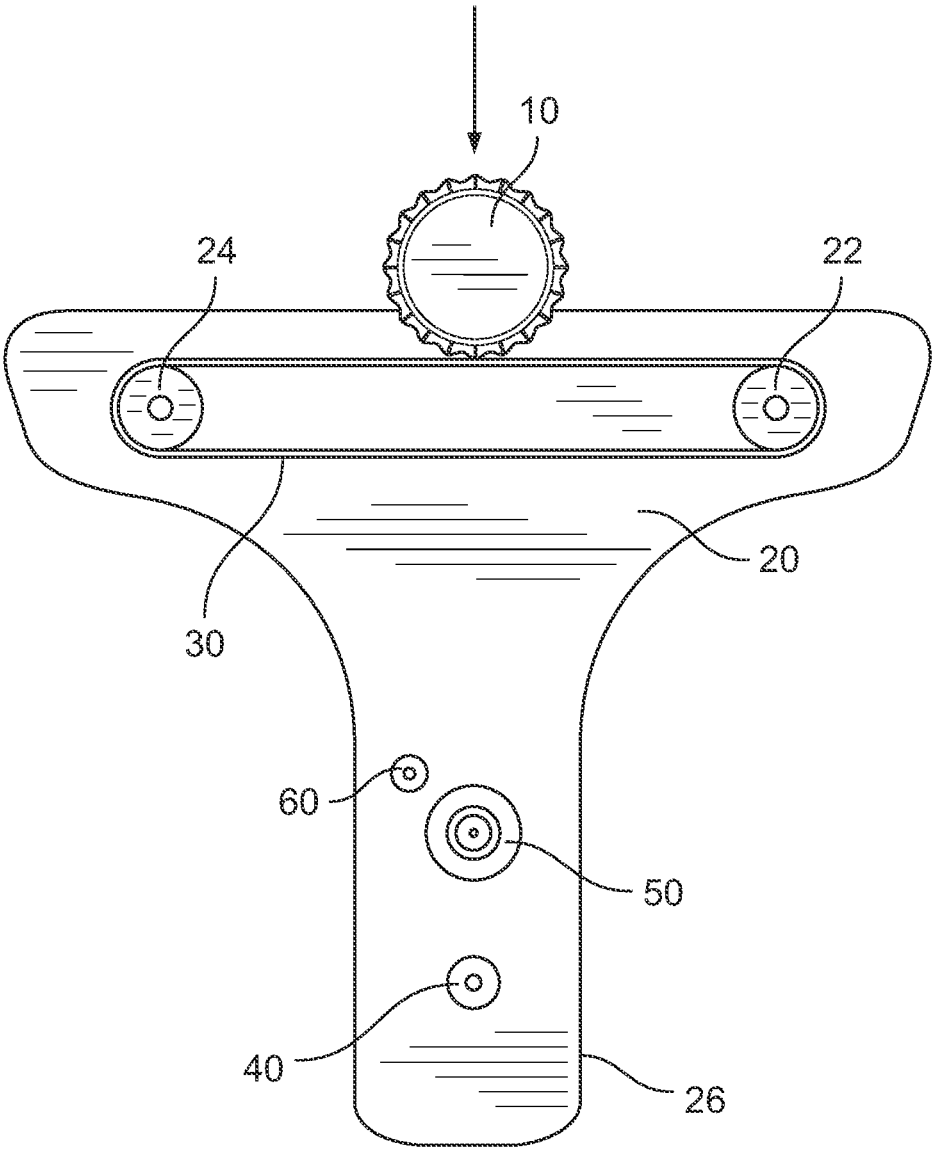
FIG. 14 is a top view of the disk launcher system with the timing post on the opposite side of the catch member in accordance with an example embodiment.

The timing post 60 extends upwardly from the upper surface of the platform 20 either in a movable manner or a non-movable manner. The timing post 60 is off-center with respect to the catch member 50 (e.g. right side as shown in FIG. 3A or left side as shown in FIG. 14). The timing post 60 is positioned upon the platform 20 in a location that forces the disk 10 to move to a left side or a right side of the timing post 60 after being released by the catch member 50 resulting in rotation of the disk 10 and also moving the disk 10 to the corresponding side along with the biasing member 30 as shown in FIG. 5B of the drawings. While the timing post 60 is shown having a cylindrical shape, the timing post 60 may have various other shapes such as, but not limited to, a triangular cross sectional shape, a square cross sectional shape and the like.

The timing post 60 may include knurling 62 to grip the disk 10 during movement of the disk 10 about the timing post 60 to help enhance the rotation of the disk 10 by reducing slippage of the disk 10 with respect to the timing post 60. The timing post 60 may also not have any knurling or other type of gripping surface (e.g. smooth surface).

While the timing post 60 may be stationary attached to the platform 20 in a non-movable manner, in one example embodiment the timing post 60 is movably positioned with respect to the platform 20. When the timing post 60 is adapted to move within an opening with the platform 20, the timing post 60 is adapted to move to a first position that extend above the upper surface of the platform 20 and move to a second position wherein an upper end of the timing post 60 is at or below the upper surface of the platform 20. When the timing post 60 is movable, the timing post 60 may be connected to the catch member 50 to move in unison with the catch member 50 by a connector member 42.

As shown in FIG. 4 of the drawings, when the timing post 60 is moved to an intermediate position between the first position and the second position, the upper end of the timing post 60 still extends above the upper surface of the platform 20 to engage the lower edge of the disk 10 while allowing the biasing member 30 to freely pass over the timing post 60 while propelling the disk 10 forwardly along the upper surface of the platform 20.

G. Launch Button

An optional launch button 40 may be movably positioned with respect to the platform 20 (e.g. movably positioned within an opening within the platform 20). The launch button 40 is connected to the catch member 50 and/or the timing post 60 so that movement of the launch button 40 by a user results in unison movement of the catch member 50 and/or the timing post 60. An exemplary launch button 40 is illustrated in FIGS. 1 through 5B of the drawings.

A connector member 42 (e.g. plate) may be connected to a lower end of the launch button 40, a lower end of the catch member 50 and a lower end of the timing post 60 as shown in FIGS. 2B, 3B and 4 of the drawings. The connector member 42 may be positioned below a lower surface of the platform 20. The connector member 42, the launch button 40, the catch member 50 and the timing post 60 all move in unison with one another so when a user pushed down on the launch button 40 the catch member 50 and the timing post 60 both move downwardly in a corresponding manner and vice versa.

H. Cover

An optional cover 70 may be attached to or near the second end of the platform 20 by at least one hinge (e.g. a first hinge 72 and a second hinge 74) as shown in FIGS. 10 through 13 of the drawings. The hinge may be comprised of any type of hinge device (e.g. strap). The cover 70 may be rigid and may be constructed of a transparent plastic to allow for viewing of the disk 10 and other components by the user during operation thereof.

Figure 13:
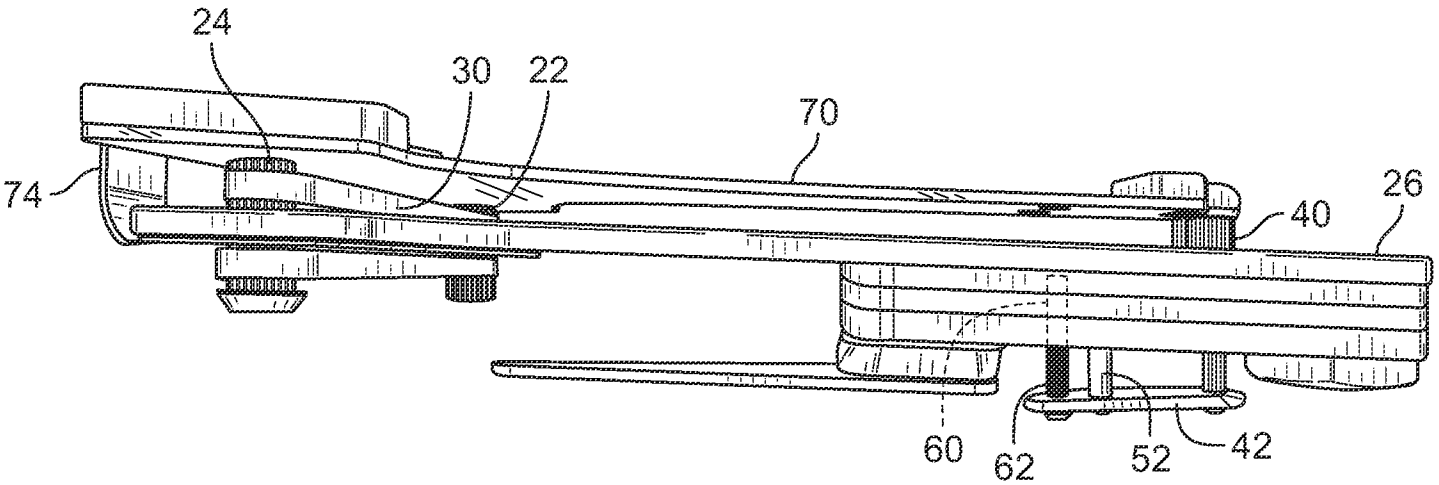
FIG. 13 is a side view of the disk launcher system in accordance with an example embodiment.

The cover 70 is adapted to be selectively moved to a removed position exposing the upper surface of the platform 20 (FIGS. 10 and 11) for loading of the disk 10 upon the platform 20. The cover 70 is also adapted to be selectively moved to an engaged position that is near an upper end of the disk 10 on the upper surface of the platform 20 to help retain the disk 10 on the platform 20 and to protect the user (FIGS. 12 and 13).

Figures 10, 11, 12:
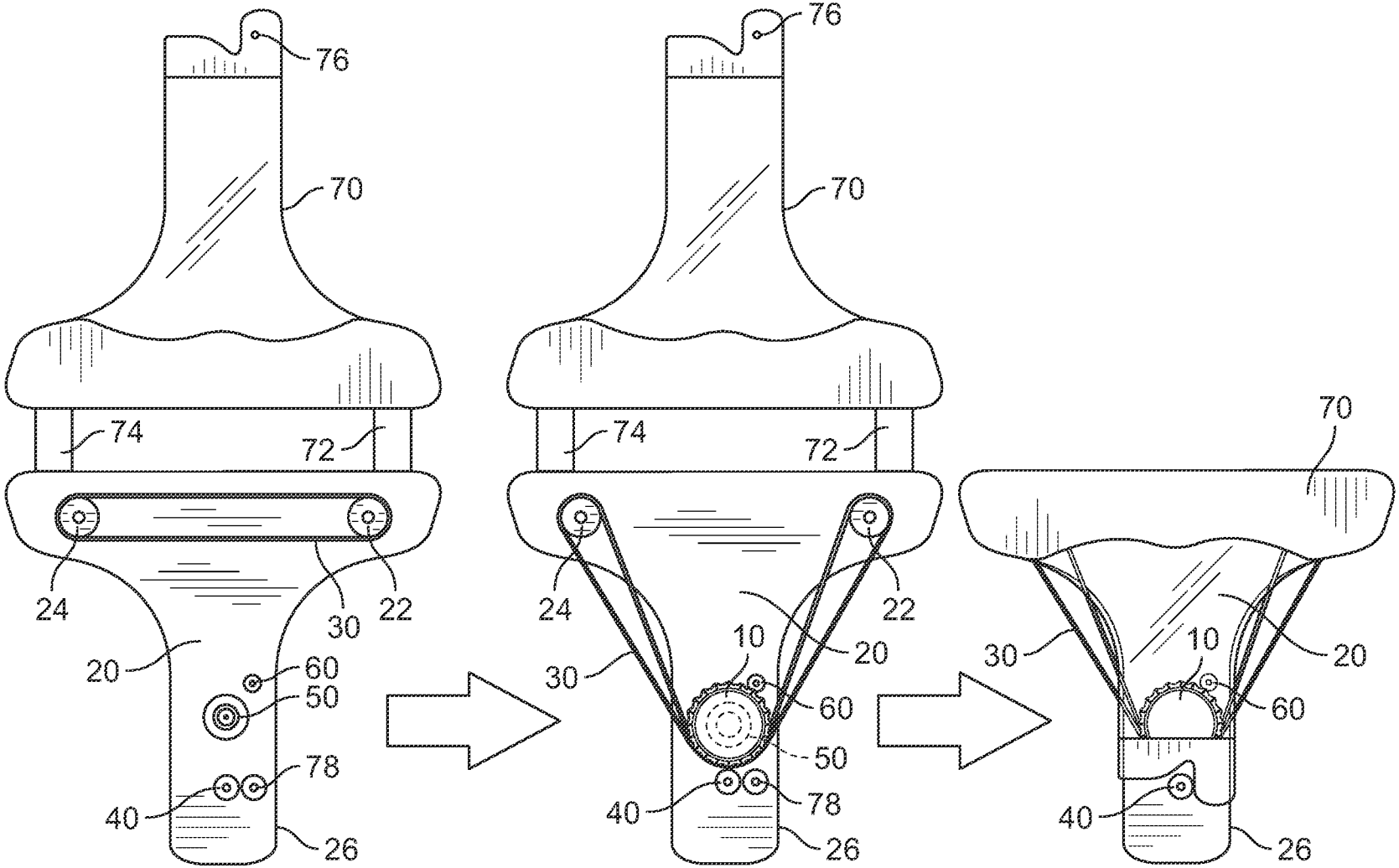
FIG. 10 is a top view of the disk launcher system with a cover in the open position in accordance with an example embodiment.
FIG. 11 is a top view of the disk launcher system with a cover in the open position and the disk in the cocked position in accordance with an example embodiment.
FIG. 12 is a top view of the disk launcher system with a cover in the closed position with the disk in the cocked position in accordance with an example embodiment.

A platform 20 magnetic element may be attached to the platform 20 near the first end as shown in FIG. 10. The cover 70 may include a cover magnetic element 76 (magnet or metal) that magnetically couples to the platform magnetic element 78 (magnet or metal) when the cover 70 is in the engaged position to retain the cover 70 in the engaged position. The cover 70 may be parallel with respect to the upper surface when the cover 70 is in the engaged position as shown in FIG. 13 of the drawings.

I. Disk

Figure 8:
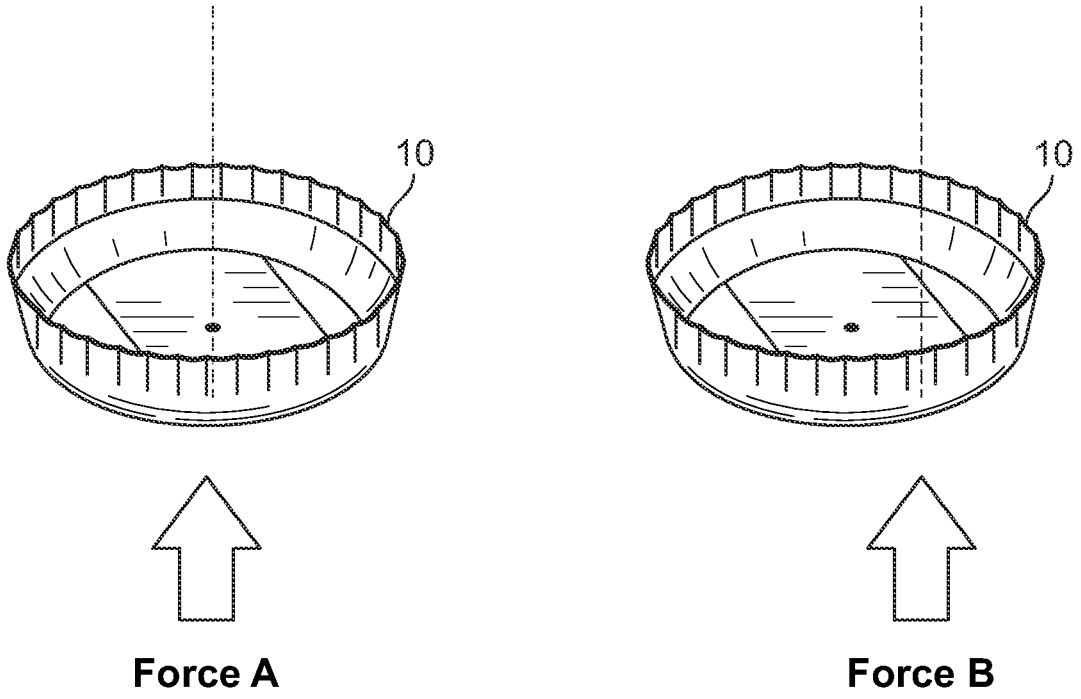
FIG. 8 is a perspective view of the disk showing the Force A at the center of the disk and the Force B offset from the center of the disk.
Figure 9:
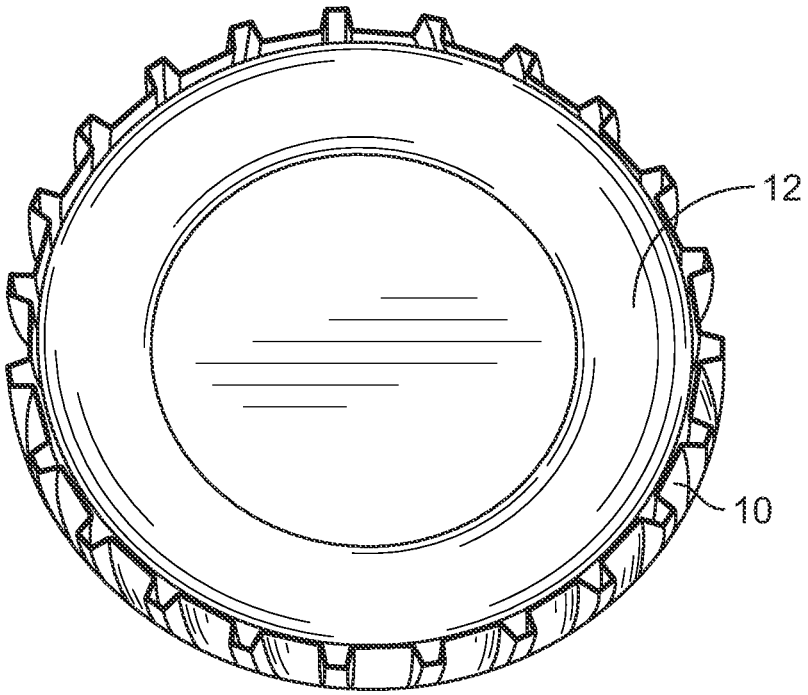
FIG. 9 is a perspective view of the disk with a weight in accordance with an example embodiment.

The disk 10 may be comprised of any disk 10 shaped or other shaped object capable of being launched into the air. One example embodiment of the disk 10 is a conventional metal bottle cap which is magnetically attracted to by the catch member 50 when the catch member 50 includes a magnet (FIGS. 2A, 3A and 8). In another example embodiment, the disk 10 may be a conventional metal bottle cap that includes a circular weight 12 (e.g. rubber O-ring) attached to an interior portion of the bottle cap along the interior perimeter edge as shown in FIG. 9 of the drawings. Various other devices and objects may be used for the disk 10 that are capable of being launched off the platform 20.

J. Operation of Example Embodiment

Figure 7:
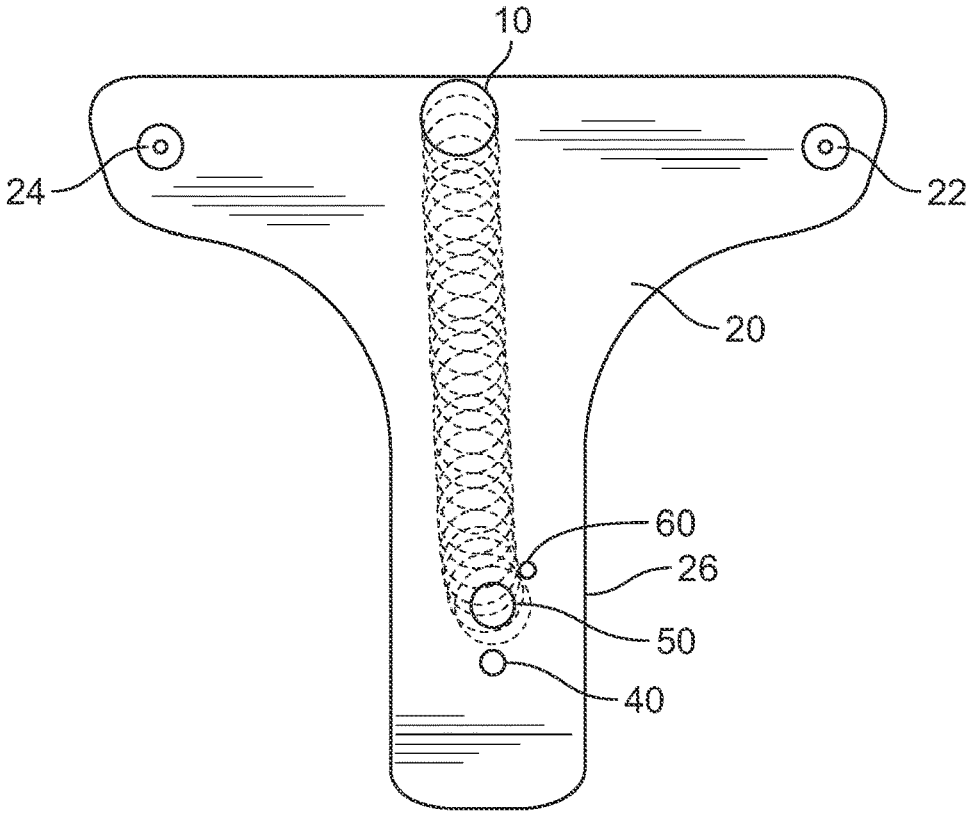
FIG. 7 is a top view illustrating the movement of the disk after being released in accordance with an example embodiment.

In use, the user positions the disk 10 near the second end of the platform 20 against the outer portion of the biasing member 30 as shown in FIG. 2A of the drawings. The user then pulls rearwardly on the disk 10 and the biasing member 30 towards the first end of the platform 20 until the disk 10 is positioned above the catch member 50 which stretches the biasing member 30. The user then pushes upwardly on the connector member 42 to cause the catch member 50 to magnetically engage the disk 10 (or alternatively the magnet of the catch member 50 pulls the catch member 50 upwardly automatically to engage the disk 10) to prevent the disk 10 from moving from the cocked position as shown in FIGS. 3A, 3B, 5A and 12. If a cover 70 is present, the user will then close the cover 70 as shown in FIGS. 12 and 13 of the drawings. The user then aims the second end of the platform 20 towards a target or area they would like the disk 10 to be launched towards and then push downwardly upon the launch button 40. When the user pushes downwardly upon the launch button 40 the catch member 50 is lowered to the intermediate position which allows for release of the disk 10 from the catch member 50 as shown in FIGS. 4 and 5B of the drawings. The disk 10 is then pulled forwardly by the biasing member 30 but since the timing post 60 is partially in front of the disk 10 in an offset manner the disk 10 has to move to the side of the post which results in rotation of the disk 10 and tightening of the biasing member 30 on one of the two segments of the biasing member 30 (the first segment of the biasing member 30 is on the left side of the disk 10 and the second segment of the biasing member 30 is on the right side of the disk 10). The biasing member 30 pulls the disk 10 forwardly along a path similar to what is shown in FIG. 7 of the drawings since the timing post 60 is still at least partially extended above the upper surface of the platform 20. The disk 10 follows the upper surface of the platform 20 and is ejected from the platform 20 in a relatively horizontal manner along with significant rotation to extend the distance of the projectile.

K. Alternative Embodiments and Variations

The launch body (e.g. platform) offers a framework to attach an elastic band and provides a flat, smooth, and rigid structure from which a disk shaped projectile may be launched. The launch body may also offer storage and display of the disk shaped projectiles.

In one example embodiment, the launch body offers a framework to attach an elastic band and provides a structure for launching disk shaped projectiles. The launch deck is flat, smooth, and generally constructed of a rigid material such as MDF or plastic. The launch deck may be wider across the front and taper toward the back to save material. Beneath the launch deck are a front spline and a center spline to add rigidity and provide a location to hold the launch body when in use. On the forward face of the front spline is a disk storage location. This easily accessible disk storage may take the form of magnets in the case of metallic disks such as bottle caps, or a pouch to hold plastic disks. Toward the forward end of the launch deck surface are two elastic band supports to secure a rubber band or other elastic material. The elastic band supports are spaced far enough apart to maintain tension on the elastic band when the band is at rest. The elastic band supports may be positioned at any of the available elastic band support locations depending on the user's preference, elastic band size, and desired launch outcome. An elastic band restrictor may be placed at one of multiple locations about the launch deck surface or may be removed entirely.

The launch body of the example embodiment may be of almost unlimited different dimensions and constructions as long as it offers a generally flat, smooth, and rigid surface from which to launch disks. The absence of complicated triggers, guides, flanges, housings, and loaders on the example embodiment may be considered a feature. One main intention is to include what is necessary for learning and performing proper launch technique by hand, creating a disk launching apparatus that functions largely based upon a user's skill and proficiency. It is expected that anything presented herein can be complicated with the addition of automated functions.

The elastic band may be symmetrical in its size and elasticity throughout. One of a multitude of commonly obtained rubber bands (size #62, #63, and #64 rubber bands) may be employed in the operation of the example embodiment. The function of the elastic band is to be stretched and subsequently released so as to slingshot a disk shaped projectile.

The elastic band is placed in tension around the supports on the launch body so that disks can be pulled against it to increase their potential energy. The height of the elastic band is similar to the vertical dimension of the disk shaped projectile being used. The elastic band is held in place around the elastic band supports so the height of the band forms a near right angle to the plane of the launch deck surface.

A rubber band is used in the example embodiment, although various bands with elastic properties may be used. The size and power of the elastic band is chosen according to the disk shaped projectile being launched and the expected outcome.

One example of a disk shaped projectile suitable for use with the various embodiments disclosed is the ubiquitous metal bottle cap commonly found on soda and beer bottles. The profile is flat across the bottom, vertical on the sides, with ridges for extra gripping power on the elastic band, and has a smooth rounded upper edge which helps with aerodynamics and smooth release. The function may be to fly accurately, fly far, or to strike obstacles placed in front of the launch body.

The disk shaped projectile used with the example embodiment is a crown cap, commonly referred to as a bottle cap. Bottle caps offer a profile with a flat bottom, ridged vertical outside wall, and a rounded top edge. This profile is quite advantageous for use with the invention described herein. The flat bottom face of the bottle cap permits stability on the launch deck which can be important for consistent interaction with the elastic band. The ridged vertical side wall of the bottle cap provides a face to transmit forces to, and accept forces from, the elastic band The rounded top edge of a bottle cap is important for aerodynamics, but also allows a smooth release from a user's fingertips which may be equally important for proper projectile flight.

The relatively light, rigid, and hollow construction of a standard metal bottle cap permits many variations. A bottle cap can be used as a shell, inside which may be added various fixtures to assist with the expected outcome of the launched projectile. Up to a point, added weight helps with flight distance. An internal LED light assembly has been very helpful in locating the launched projectile at night, and an audible locator is contemplated for assistance with cap location in daylight. Any number and combinations of materials may be used in the construction of a plethora of disk shaped projectiles. Certainly soft plastic or rubber tipped toy projectiles may be preferred for indoor use and for use by younger children. Disks may be designed for any number of functions, but of notable interest is the development of an edible disk. Small flying disk-like treats can be launched a great distance for the family dog without wearing out the owner's arm, or fish food in the form of a dissolvable disk may be launched far into a body of water.

Elastic band supports and restrictors may be attached to the surface of the launch deck by a number of means. In the example embodiment the launch deck has been drilled so that a bolt may be passed through the launch deck from the underside, allowing an elastic band support or restrictor to be a form of threaded nut. In this manner, the elastic band supports and restrictor can be removed and positioned at any of the potential locations drilled into the launch deck. This allows elastic bands of varying size and length to be used on the same launch deck It is less important that the front spline and center spline be removable, so in the example embodiment the splines and launch deck have been created of MDF and irremovably glued together. Recessed and glued in the front face of the front spline are a multitude of magnets to which the metallic bottle caps may be removably attached so as to provide quick access to projectiles.

An alternative variation of the various embodiments includes a trigger and safety catch mechanism. This variation has been constructed in the same fashion as the example embodiment with the addition of a magnetic safety catch to retain the projectile in its loaded state with the elastic band in its high energy stretched position. The safety catch can then be retracted, which simultaneously releases the projectile, much as if using a crossbow. Alternatively, the projectile can be held with the fingertips while the safety catch is disengaged, then the projectile can be released.

This is a more complicated, more expensive, somewhat ineffective, and generally unnecessary variation but could prove to be of significant use if further developed. The fact that the launcher has to be loaded to employ the safety can be circumvented by not loading the launcher in the first place. It will be made clear in the description of operation that the preferred use of the launcher involves the fingertips maintaining contact with the disk throughout the process of drawing back and holding the projectile to the point of release. In the description of operation this invention teaches that the preferred launch technique is critically influenced by the fingertips, thus subtracting the fingertips from the launch equation with the addition of a trigger is deemed to be overly complicated and less effective. When the disk projectile is released with the trigger mechanism it typically flips and flutters and does not maintain a true flight because it has very little rotation.

This variation may offer some benefit when the elastic band is quite strong. The projectile may be drawn back and the safety engaged to relieve the strain on the users hand, then the user can reengage the projectile with the hand, disengage the safety, and release from the fingertips.

The operation of this embodiment is first discussed without the elastic band restrictor in place. The elastic band supports are positioned in the outermost holes on each side of the launch deck and a rubber band is placed around the supports. A user's non-dominant hand would preferably hold the center spline on the underside of the launch deck towards the front spline. A bottle cap is placed on the launch deck forward of the center of the rubber band. In order to induce bottle cap rotation it is not necessary to stretch the elastic band unequally or use asymmetrical band placement or set up in any way a situation where there will be asymmetry in the elastic band prior to bottle cap release. The various embodiments herein allow tremendous bottle cap rotation with the correct grip and release technique.

With the bottle cap centered in front of the rubber band bring the tip of the middle finger of the dominant hand into contact with the front rim of the bottle cap and pull towards the back of the launch deck just enough to get the front segment of the rubber band to touch the back segment of the rubber band. At this point, place the tip of the index finger on top of the center of the bottle cap to keep the cap lightly pressed against the launch deck surface. Then place the thumb on the back side of the cap, trapping both segments of the rubber band up against the cap.

There is no significant tension on the rubber band at this point and there are three points of contact between the hand and the bottle cap. The middle finger, index finger, and thumb will generally be lined up from front to back on the bottle cap. It is critical that the middle finger contact the front rim of the bottle cap slightly off center. On a clock face the middle finger would be at about 12:30 and the thumb would be at about 6:30 for a right handed user. For a left handed user the middle finger would be at 11:30 and the thumb at 5:30. In either case the index finger is placed in the center of the cap. The hand should be held at about a 45 degree angle to the plane of the launch deck, roughly the same angle that one would hold a pen or pencil.

The cap is then drawn straight back down the middle of the launch deck using this three finger grip. The user will begin to feel the tension building in the rubber band and feel the bottle cap pressing back against the middle finger. When the tension is strong enough to stop the drawback, or when the cap nears the end of the launch deck, the bottle cap is released. The release by all three fingers may be perceived to happen simultaneously, however the index finger may be lifted prior to the other two, then the thumb, and finally the middle finger. The release should happen very quickly and there will be no time to think about moving the individual fingers. There should definitely be the sense that the middle finger is allowing the rubber band to sweep the cap from beneath the finger. There should not be any sense of grabbing the bottle cap as the fingers are removed from the cap. The middle finger's position on the front of the cap and its removal is generally what determines success or failure. If the middle finger is struck by the rubber band there is no pain, but the shot will often be muted or go off the desired path.

What is believed to happen (when viewed from above for a right handed user) when the cap begins to move forward with the middle finger still in light contact at 12:30 on the top front rim of the cap is that the cap rotates clockwise at first which moves the cap slightly to the right causing the rubber band to lag behind on the right side when the cap and band are moving forward. When the cap leaves the rubber band the right side of the middle of the rubber band is the last to whip forward. This whipping forward of the center right portion of the rubber band causes the cap to move strongly counterclockwise for a right handed user. The opposite is true for a left handed user of this technique. This spin creation can be verified by aiming the launcher straight up and softly launching a spirally painted bottle cap. One may also notice with a launcher aimed skyward that a rubber band fully drawn back and fired without a bottle cap will project quite a distance beyond the front edge of the launch deck. This can help us visualize the forces involved in launching the bottle cap and causing it to rotate. As of the writing of this provisional patent application no slow motion verification has been performed and the above explanation is a theory.

Variants of the three finger technique described above are certainly possible and may be preferred by some. One variant involves placing both the index and middle finger on the front rim of the cap and the thumb on top of the cap. Another variant is to simply use the index finger on the front of the cap and the thumb on the back. All five fingers may be used in any desired combination, but the most effective spin generation will still be provided by a release that causes the disk and elastic band to perform as in the above description.

Before the preferred technique was developed it was thought that restricting the forward most travel of one side of the rubber band was necessary to induce bottle cap rotation. The elastic band restrictor may still offer benefit to a beginning user. The restrictor is placed in a hole towards the center of the launch deck from the elastic band support on the left side of the deck for a right handed person. Both front and rear segments of the rubber band are placed behind the restrictor. When the cap is drawn back the elastic band is unimpeded in its rearward travel. It is on the forward travel that the left side of the rubber band strikes the restrictor and the band's forward progress is halted on the left side, allowing the right side to travel forward and cause rotation. The restrictor is not generally preferred by experienced users because the rubber band's power is muted to some degree with the restrictor in place.

The various embodiments disclosed herein create spin by pushing eccentrically on the disc. To illustrate, we can place a regular metal bottle cap upside down on a table and flick the bottle cap away from us by striking its rim dead center (Force A in FIG. 8) and it can slide without spinning. However, if we decenter the force of the flick (Force B in FIG. 8), the bottle cap can slide and spin.

Shooting discs with spin from an elastic band involves applying the force of propulsion off center. We can move the force or the center of mass, or as in the case of this proposed various embodiments both. The launch can be done manually as detailed in the provisional application, or automatically now with bottle cap shooting crossbows developed since the provisional was written. Crossbows allow a user to load the bottle cap and push a button to shoot, easing the learning curve significantly and minimizing dependence on technique. The crossbow uses a simple mechanism analogous to how the manual technique works.

The bottle cap is placed on the launch deck in preparation for drawback onto a catch and release assembly called a cage This cage moves vertically, yoked together as one piece inside the body of the crossbow to synchronize the launch.

One function of the cage is to automatically catch the bottle cap and hold it in place when pulled rearward. To achieve this, the push button is held down (typically by the thumb of the non-dominant hand) as the bottle cap is slid rearward on the launch deck against the tension of the rubber band by the fingers of the dominant hand. After the entire bottle cap has been pulled rearward past the timing post the push button may be released to allow the cage to rise automatically due to rare earth magnets on the catch post being attracted to the common steel bottle cap. The catch post is magnetically pulled up into the bottle cap securing the cap behind the timing post as seen in FIG. 3B. The user can then let go of the bottle cap as it is now securely loaded in the crossbow The catch post and timing post positions have been configured to allow the bottle cap now under significant force from the rubber band to transfer the majority of the force to the catch post. For more consistent bottle cap launches, the timing post should be contacting the bottle cap between two of the ridges on the external rim of the bottle cap To reposition the bottle cap, simply pull the cap back slightly and rotate the cap so the timing post is between two ridges.

With respect to the line of fire, the timing post is decentered to the right. When the bottle cap is released, the eccentric position of the timing post initiates a sequence of events that causes the bottle cap to spin. When the push button is depressed, the entire cage moves downward. First, the catch post drops below the launch deck of the crossbow allowing the bottle cap to be acted upon by the rubber band. For just a brief moment the timing post remains in front of the bottle cap as seen in FIG. 5B. The timing post briefly interferes with the forward movement of the bottle cap causing the cap to deflect to one side (left or right), which in turn alters the stretch of the rubber band The rubber band has been omitted from view in FIG. 7.

FIG. 5B shows the bottle cap position at the moment the catch post drops below the launch deck of the crossbow. The timing post is still in front of the cap in FIG. 5B. The force of the rubber band causes the bottle cap to pivot left, with the pivot point located at the point of contact between the bottle cap and the timing post. FIG. 5B shows the bottle cap at the moment before the timing post drops below the launch deck of the crossbow wherein the bottle cap has rotated clockwise and shifted to the left, which has increased the stretch of the rubber band on the right side of the bottle cap and decreased the stretch on the left side of the bottle cap.

Figure 6:
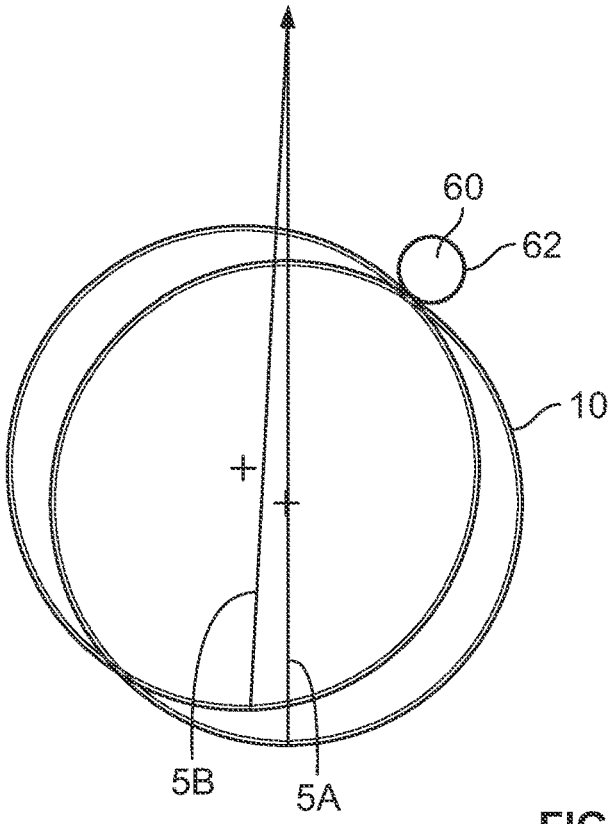
FIG. 6 is a top view illustration showing the disk going around the timing post when being released in accordance with an example embodiment.

FIG. 6 depicts the bottle cap's position in FIGS. 5A and 5B superimposed on one another. Notice the center of the cap moved to the left from 5A to 5B, and the force vector of the rubber band is angled to the right in 5B because the right side of the rubber band now has more tension than the left. The timing post also moves the cap left and the rubber band force to the right. The misalignment of the center of mass of the bottle cap from the force vector of the rubber band is the genesis of the spin that will occur during bottle cap flight.

With the force vector of the rubber band now directed off center, all that remains is to get the timing post out of the way. When the timing post drops beneath the launch deck of the crossbow the force of the rubber band takes over. Because the force is predominantly forward the bottle cap accelerates forward very quickly, and because the force is applied from behind and to the right of center the cap rotates counterclockwise. There is a fast but smooth transmission of power from the rubber band to the disc and the spin generated is an expression of torque resulting from an off center force acting on a rotationally symmetrical body.

When the catch post drops the cap is laterally displaced to the left by the mechanism which also increases the tension on the right side of the cap, and the cap identifies this as more coiling. When the timing post drops, the coil will uncoil. The purpose of this description is to point out that the mechanism of action is simply a well-timed change in tension to essentially trick the cap into behaving as if it has been coiled.

The actual path taken by the disk as it moves over the launch deck is depicted in FIG. 7. This path shows the cap coming off the front of the crossbow angled slightly to the left even though the force vector is angled to the right.

The same magnet that allows the catch post to be drawn up into the bottle cap when loading the crossbow is instrumental in keeping the bottle cap oriented upon release. Without the rare earth magnet holding the bottle cap down to the launch deck surface upon release the bottle cap would flip over the timing post and misfire. Magnetic crossbows, which rely solely on the magnet to hold down the bottle cap, are currently limited to shots of around 100 feet because there's an upper limit to how powerful the rubber band can be in relation to the strength of the magnet. One way to circumvent the limitations of magnet strength is to place a cover over the bottle cap once it's loaded in the crossbow. Higher power elastic bands and specialized discs may then used to reach extreme distances.

When the covered crossbow (FIGS. 10 through 13) is fired the bottle cap is forced to stay level as it moves forward over the launch deck. After a few iterations of larger and larger covered crossbows with longer and stronger elastic bands, I've noticed the mechanism that creates spin begins to reach a limit. Eventually the bottle cap's small size and light weight gets overpowered by the strength of the elastic band. To scale up the elastic band power without scaling up the diameter of the disk a user can add weight to the bottle cap (FIG. 9). The increased inertia increases the length of time the force vector is deflected. Increasing weight, up to a certain point, also helps the flight characteristics of a bottle cap. Another option is to bias the tension on one side of the elastic band. The elastic band is stretched and placed behind the bottle cap with more tension on the right side, increasing the force vector deflection, effectively "coiling" the cap for more spin.

A user may also increase the power using nested rubber bands, or one rubber band placed around the other. Another adjustment is to thin the bottle cap. Shaving just 1 mm off the bottom rim of the bottle cap noticeably improves aerodynamics.

The three finger technique works when using a simple bottle cap slingshot. The middle finger is analogous to the timing post, the index finger is analogous to the magnet and cover holding down the bottle cap, and the thumb is there mainly for support. The middle finger will briefly interrupt the forward travel of the bottle cap and cause the cap's center of mass to become misaligned with the force vector of the rubber band just as with the crossbow. The fingers can hold the bottle cap down with more force than the magnet, allowing the manual technique to shoot farther than the magnet-only crossbows. However, covered crossbows offer the greatest distances because they concentrate the power of the rubber band more precisely and do not rely on hand strength or technique.

Glow in the dark tape and small glow sticks may be attached to the bottle cap to make it easier to see in the air and easier to find on the ground. Blinking LED lights powered by a small battery attached to the disk may also be used to increase visibility. Other options may include audible discs, RFID, GPS, and perhaps larger, fully lit discs that save data from the shot.

Unless otherwise defined, all technical and scientific terms used herein have the same meaning as commonly understood by one of ordinary skill in the art to which this invention belongs. Although methods and materials similar to or equivalent to those described herein can be used in the practice or testing of the disk launcher system, suitable methods and materials are described above. All publications, patent applications, patents, and other references mentioned herein are incorporated by reference in their entirety to the extent allowed by applicable law and regulations. The disk launcher system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A disk launcher, comprising:

a platform having an upper surface, a first end and a second end opposite of the first end, wherein the upper surface is planar;

a biasing member attached to the platform, wherein the biasing member is adapted to apply a biasing force to a disk positioned on the platform to launch the disk in a direction extending from the first end towards the second end of the platform;

a catch member movably positioned with respect to the platform, wherein the catch member is adapted to move to a first position to retain the disk in a cocked position and wherein the catch member is adapted to move to a second position to release the disk from the cocked position; and a timing post extending upwardly from the upper surface of the platform, wherein the timing post is off-center with respect to the catch member, and wherein the timing post is positioned upon the platform in a location that forces the disk to move to a side of the timing post after being released by the catch member resulting in rotation of the disk.

2. The disk launcher of claim 1, wherein the platform has a T-shape forming a handle near the first end of the platform.

3. The disk launcher of claim 1, wherein the biasing member is attached near the second end of the platform.

4. The disk launcher of claim 1, including a first post and a second post attached to the platform near the second end of the platform, wherein the first post is near a first side of the platform and wherein the second post is near a second side of the platform opposite of the first post, and wherein the biasing member is connected to the first post and the second post.

5. The disk launcher of claim 4, wherein the biasing member is comprised of an elastic band.

6. The disk launcher of claim 5, wherein the biasing member is comprised of a rubber band.

7. The disk launcher of claim 1, wherein the biasing member is comprised of an elastic band.

8. The disk launcher of claim 1, wherein the disk is comprised of a bottle cap.

9. The disk launcher of claim 8, wherein the bottle cap includes a circular weight attached to an interior portion of the bottle cap.

10. The disk launcher of claim 1, wherein the timing post is movably positioned with respect to the platform, wherein the timing post is adapted to move to a first position to extend above the upper surface of the platform and wherein the timing post is adapted to move to a second position wherein an upper end of the timing post is at or below the upper surface of the platform.

11. The disk launcher of claim 10, wherein the timing post is connected to the catch member, wherein the timing post moves in unison with the catch member.

12. The disk launcher of claim 11, including a launch button movably positioned with respect to the platform, wherein the launch button is connected to the catch member and the timing post, and wherein movement of the launch button by a user results in unison movement of the catch member and the timing post.

13. The disk launcher of claim 12, including a connector member connected to a lower end of the launch button, a lower end of the catch member and a lower end of the timing post, wherein the connector member is positioned below a lower surface of the platform.

14. The disk launcher of claim 1, including a launch button movably positioned with respect to the platform, wherein the launch button is connected to the catch member, and wherein movement of the launch button by a user results in unison movement of the catch member.

15. The disk launcher of claim 1, wherein the timing post includes a knurling, wherein the knurling is adapted to grip the disk during movement of the disk.

16. The disk launcher of claim 1, wherein the catch member is comprised of a magnet attached to a support post, wherein the magnet is adapted to magnetically engage the disk to selectively retain the disk in the cocked position.

17. The disk launcher of claim 1, including a cover attached to or near the second end of the platform by at least one hinge, wherein the cover is adapted to be selectively moved to a removed position exposing the upper surface of the platform and wherein the cover is adapted to be selectively moved to an engaged position that is near an upper end of the disk on the upper surface of the platform.

18. The disk launcher of claim 17, including a platform magnetic element attached to the platform near the first end, wherein the cover includes a cover magnetic element that magnetically couples to the platform magnetic element when the cover is in the engaged position to retain the cover in the engaged position.

19. A disk launcher, comprising:

a platform having an upper surface, a first end and a second end opposite of the first end, wherein the upper surface is planar;

a first post and a second post attached to and extending upwardly from the platform near the second end of the platform, wherein the first post is near a first side of the platform and wherein the second post is near a second side of the platform opposite of the first post;

a biasing member attached to the first post and the second post extending upwardly from the platform, wherein the biasing member is adapted to apply a biasing force to a disk positioned on the platform to launch the disk in a direction extending from the first end towards the second end of the platform, and wherein the biasing member is attached near the second end of the platform;

wherein the biasing member is comprised of an elastic band;

a catch member movably positioned with respect to the platform, wherein the catch member is adapted to move to a first position to retain the disk in a cocked position and wherein the catch member is adapted to move to a second position to release the disk from the cocked position;

a timing post extending upwardly from the upper surface of the platform, wherein the timing post is off-center with respect to the catch member, wherein the timing post is positioned upon the platform in a location that forces the disk to move to a side of the timing post after being released by the catch member resulting in rotation of the disk, and wherein the timing post includes a knurling, wherein the knurling is adapted to grip the disk during movement of the disk;

wherein the timing post is movably positioned with respect to the platform, wherein the timing post is adapted to move to a first position to extend above the upper surface of the platform and wherein the timing post is adapted to move to a second position wherein an upper end of the timing post is at or below the upper surface of the platform;

a launch button movably positioned with respect to the platform, wherein the launch button is connected to the catch member and the timing post, and wherein movement of the launch button by a user results in unison movement of the catch member and the timing post; and a connector member connected to a lower end of the launch button, a lower end of the catch member and a lower end of the timing post, wherein the connector member is positioned below a lower surface of the platform, and wherein the connector member, the launch button, the catch member and the timing post all move in unison with one another.

20. A disk launcher, comprising:

a platform having an upper surface, a first end and a second end opposite of the first end, wherein the upper surface is planar, and wherein the platform has a T-shape forming a handle near the first end of the platform;

a first post and a second post attached to and extending upwardly from the platform near the second end of the platform, wherein the first post is near a first side of the platform and wherein the second post is near a second side of the platform opposite of the first post;

a biasing member attached to the first post and the second post extending upwardly from the platform, wherein the biasing member is adapted to apply a biasing force to a disk positioned on the platform to launch the disk in a direction extending from the first end towards the second end of the platform, and wherein the biasing member is attached near the second end of the platform;

wherein the biasing member is comprised of an elastic band;

a catch member movably positioned with respect to the platform, wherein the catch member is adapted to move to a first position to retain the disk in a cocked position and wherein the catch member is adapted to move to a second position to release the disk from the cocked position;

wherein the catch member is comprised of a magnet attached to a support post, wherein the magnet is adapted to magnetically engage the disk to selectively retain the disk in the cocked position;

a timing post extending upwardly from the upper surface of the platform, wherein the timing post is off-center with respect to the catch member, wherein the timing post is positioned upon the platform in a location that forces the disk to move to a side of the timing post after being released by the catch member resulting in rotation of the disk, and wherein the timing post includes a knurling, wherein the knurling is adapted to grip the disk during movement of the disk;

wherein the timing post is movably positioned with respect to the platform, wherein the timing post is adapted to move to a first position to extend above the upper surface of the platform and wherein the timing post is adapted to move to a second position wherein an upper end of the timing post is at or below the upper surface of the platform;

a launch button movably positioned with respect to the platform, wherein the launch button is connected to the catch member and the timing post, and wherein movement of the launch button by a user results in unison movement of the catch member and the timing post;

a connector member connected to a lower end of the launch button, a lower end of the catch member and a lower end of the timing post, wherein the connector member is positioned below a lower surface of the platform, and wherein the connector member, the launch button, the catch member and the timing post all move in unison with one another; and a cover attached to or near the second end of the platform by at least one hinge, wherein the cover is adapted to be selectively moved to a removed position exposing the upper surface of the platform and wherein the cover is adapted to be selectively moved to an engaged position that is near an upper end of the disk on the upper surface of the platform.

* * * * *